US009732747B2

(12) United States Patent
Lin et al.

(10) Patent No.: US 9,732,747 B2
(45) Date of Patent: Aug. 15, 2017

(54) AIR COMPRESSION SYSTEM AND COOLING STRUCTURE THEREOF

(71) Applicant: FUSHENG INDUSTRIAL CO., LTD., New Taipei (TW)

(72) Inventors: Feng-Yung Lin, New Taipei (TW); Chih-Chung Chen, New Taipei (TW); Li-Yung Yan, New Taipei (TW)

(73) Assignee: FUSHENG INDUSTRIAL CO., LTD., New Taipei (TW)

( * ) Notice: Subject to any disclaimer, the term of this patent is extended or adjusted under 35 U.S.C. 154(b) by 386 days.

(21) Appl. No.: 14/331,195

(22) Filed: Jul. 14, 2014

(65) Prior Publication Data

US 2015/0023818 A1 Jan. 22, 2015

(30) Foreign Application Priority Data

Jul. 17, 2013 (TW) ..... 102125639 A

(51) Int. Cl.
*F04B 35/04* (2006.01)
*F04B 53/08* (2006.01)
(Continued)

(52) U.S. Cl.
CPC ..... *F04B 53/08* (2013.01); *F04B 39/02* (2013.01); *F04B 39/06* (2013.01); *F04B 39/062* (2013.01);
(Continued)

(58) Field of Classification Search
CPC ..... F04B 53/08; F04B 53/20; F04B 39/062; F04B 39/064; F04B 39/06; F04B 39/02; F04B 29/584; F04B 29/5806
(Continued)

(56) References Cited

U.S. PATENT DOCUMENTS 4,257,749 A 3/1981 Ramm
4,693,736 A * 9/1987 Klusmier ..... F04B 39/064 62/468
(Continued)

FOREIGN PATENT DOCUMENTS

CN 1108357 A 9/1995
CN 1216098 A 5/1999
(Continued)

OTHER PUBLICATIONS

Office Action dated May 7, 2015 of the corresponding Taiwan patent application.
(Continued)

*Primary Examiner* — Charles Freay
(74) *Attorney, Agent, or Firm* — Chun-Ming Shih; HDLS IPR Services

(57) ABSTRACT

An air compression system includes an air compression device and a cooling structure. The air compression device includes a liquid-cooled motor and a compressor. The cooling includes a radiator, a cooler, a first liquid conveying tube, a second liquid conveying tube, a third liquid conveying tube, a fourth liquid conveying tube and a cooling liquid. The radiator interconnects the compressor for cooling a lubricating liquid in the compressor; the first liquid conveying tube interconnects the radiator and the cooler; the second liquid conveying tube interconnects the radiator and the cooler; the third liquid conveying tube interconnects the liquid-cooled motor and the cooler; the fourth liquid conveying tube interconnects the liquid-cooled motor and the cooler; and the cooling liquid is filled into the cooler, so as to reduce the space occupied by the cooling structure.

10 Claims, 5 Drawing Sheets

(51) Int. Cl.
*F04B 53/20* (2006.01)
*F04D 29/58* (2006.01)
*F04B 39/02* (2006.01)
*F04B 39/06* (2006.01)

(52) U.S. Cl.
CPC ..... *F04B 39/064* (2013.01); *F04B 53/20* (2013.01); *F04D 29/584* (2013.01); *F04D 29/5806* (2013.01)

(58) Field of Classification Search
USPC ..... 417/423.8
See application file for complete search history.

(56) References Cited

U.S. PATENT DOCUMENTS 5,222,874 A * 6/1993 Unnewehr ..... F04C 29/045 417/372
5,475,985 A * 12/1995 Heinrichs ..... F25B 31/008 62/117
5,694,780 A * 12/1997 Alsenz ..... F04B 39/062 417/228
6,450,781 B1 * 9/2002 Petrovich ..... F04D 25/16 310/55
2004/0146414 A1 7/2004 Nichol
2011/0000227 A1 * 1/2011 Kamiya ..... F04C 23/006 62/6
2011/0008184 A1 * 1/2011 De Boer ..... F04D 25/06 417/228
2012/0107143 A1 * 5/2012 Gilarranz ..... F04D 25/0606 417/53

FOREIGN PATENT DOCUMENTS

| | | | |
|---|---|---|---|
| CN | 1289895 | A | 4/2001 |
| CN | 1862019 | A | 11/2006 |
| CN | 101978169 | A | 2/2011 |
| CN | 202742647 | U | 2/2013 |
| JP | H04128577 | A | 4/1992 |
| JP | H09236338 | A | 9/1997 |
| JP | 2008082623 | A | 4/2008 |

OTHER PUBLICATIONS

Office Action dated Jan. 21, 2016 of the corresponding China patent application.

* cited by examiner

AIR COMPRESSION SYSTEM AND COOLING STRUCTURE THEREOF

FIELD OF THE INVENTION

The present invention relates to an air compression system, and more particularly to an air compression system and a cooling structure thereof.

BACKGROUND OF THE INVENTION

Air compression system is used extensively in various areas including industries, commerce, home use, entertainment, and transportation areas, etc. Whenever there is a need of compressing air into high-pressure gas, an air compression system may be used for the purpose. However, when the air compression system compresses the air, the compressor and the motor used for driving the compressor will generate heat energy. To prevent the heat energy generated by the compressor and the motor from deforming the internal structure and damaging the efficiency and durability of the compressor and the motor, separate cooling structure is installed to the compressor and the motor to cool down the compressor and the motor.

In general, the motor of a conventional air compression system is air-cooled by a cooling structure, which includes a bundled air-cooled fan blade or an external air-cooled fan blade to cool the motor. However, the compressor is cooled by a liquid-cooled cooling structure. By cooling the lubricating liquid in the compressor, the compressor is then cooled by the lubricating liquid to achieve the effect of cooling the compressor, so that the cooling structure of the motor and the compressor is a cooling structure that occupies much volume, and the bundled or external air-cooled fan blade provides a poor cooling effect that results in a lower operating efficiency and a shorter life of the motor, and also increases the level of noises of the motor. Obviously, the conventional air compression system requires improvements.

In view of the foregoing problem, the inventor of the present invention based on years of experience in the related industry to conduct extensive researches and experiments to develop an air compression system and a cooling system in accordance with the present invention to overcome the problem of the prior art.

SUMMARY OF THE INVENTION

Therefore, it is a primary objective of the present invention to provide an air compression system, wherein a cooler interconnects a radiator through a first liquid conveying tube and interconnects the liquid-cooled motor through a third liquid conveying tube to achieve the effect of cooling a lubricating liquid and a liquid-cooled motor simultaneously, so as to reduce the space occupied by the cooling structure.

To achieve the aforementioned objective, the present invention provides an air compression system comprising an air compression device and a cooling structure; wherein the air compression device comprises a liquid-cooled motor and a compressor, and the liquid-cooled motor drives the compressor, and a lubricating liquid is filled into the compressor; the cooling structure comprises a radiator, a cooler, a first liquid conveying tube, a second liquid conveying tube, a third liquid conveying tube, a fourth liquid conveying tube and a cooling liquid; the radiator interconnects the compressor for cooling the lubricating liquid; the first liquid conveying tube bridges and interconnects the radiator and the cooler; the second liquid conveying tube bridges and interconnects the radiator and the cooler; the third liquid conveying tube bridges and interconnects the liquid-cooled motor and the cooler; the fourth liquid conveying tube bridges and interconnects the liquid-cooled motor and the cooler, and a portion of the cooling liquid is filled into the cooler. A portion of the cooling liquid is inputted into the radiator through the first liquid conveying tube and flows back to the cooler through the second liquid conveying tube and another portion of the cooling liquid is inputted into the liquid-cooled motor through the third liquid conveying tube and flows back to the cooler through the fourth liquid conveying tube.

To achieve the aforementioned objective, the present invention further provides a cooling structure for an air compression system, and the air compression system comprises an air compression device having a liquid-cooled motor and a compressor, and a lubricating liquid is filled into the compressor; and the cooling structure comprises a radiator, a cooler, a first liquid conveying tube, a second liquid conveying tube, a third liquid conveying tube, a fourth liquid conveying tube and a cooling liquid. The radiator interconnects the compressor for cooling the lubricating liquid; the first liquid conveying tube bridges and interconnects the radiator and the cooler; the second liquid conveying tube bridges and interconnects the radiator and the cooler; the third liquid conveying tube bridges and interconnects the liquid-cooled motor and the cooler; the fourth liquid conveying tube bridges and interconnects the liquid-cooled motor and the cooler; the cooling liquid is filled into the cooler, and a portion of the cooling liquid is inputted into the radiator through the first liquid conveying tube and flows back to the cooler through the second liquid conveying tube, and the other portion of the cooling liquid is inputted into the liquid-cooled motor through the third liquid conveying tube and flows back to the cooler through the fourth liquid conveying tube.

The present invention has the following effects:

1. Since the liquid-cooled motor and the radiator use the same cooler, the invention achieves the effects of lowering the material cost and saving the power consumption of the air compression system.

2. Since the liquid-cooled motor is cooled by the cooling liquid provided by the cooler, the invention achieves the effects of enhancing the heat dissipating efficiency of the liquid-cooled motor to extend the life of the liquid-cooled motor and reducing the level of noise of the liquid-cooled motor.

3. Since the impurities of the lubricating liquid are filtered by the filter to prevent the impurities from entering into the compressor and ensure the normal operation of the compressor, the invention achieves the effect of extending the service life of the compressor.

4. A thermal control valve or any other temperature control system may be installed at the first liquid conveying tube for controlling the flow of the lubricating liquid passing through the radiator, so that the lubricating liquid-cooled by the radiator can be maintained at a constant temperature, and the compressor provides a better lubricating effect.

DESCRIPTION OF THE PREFERRED EMBODIMENTS

Figure 1:
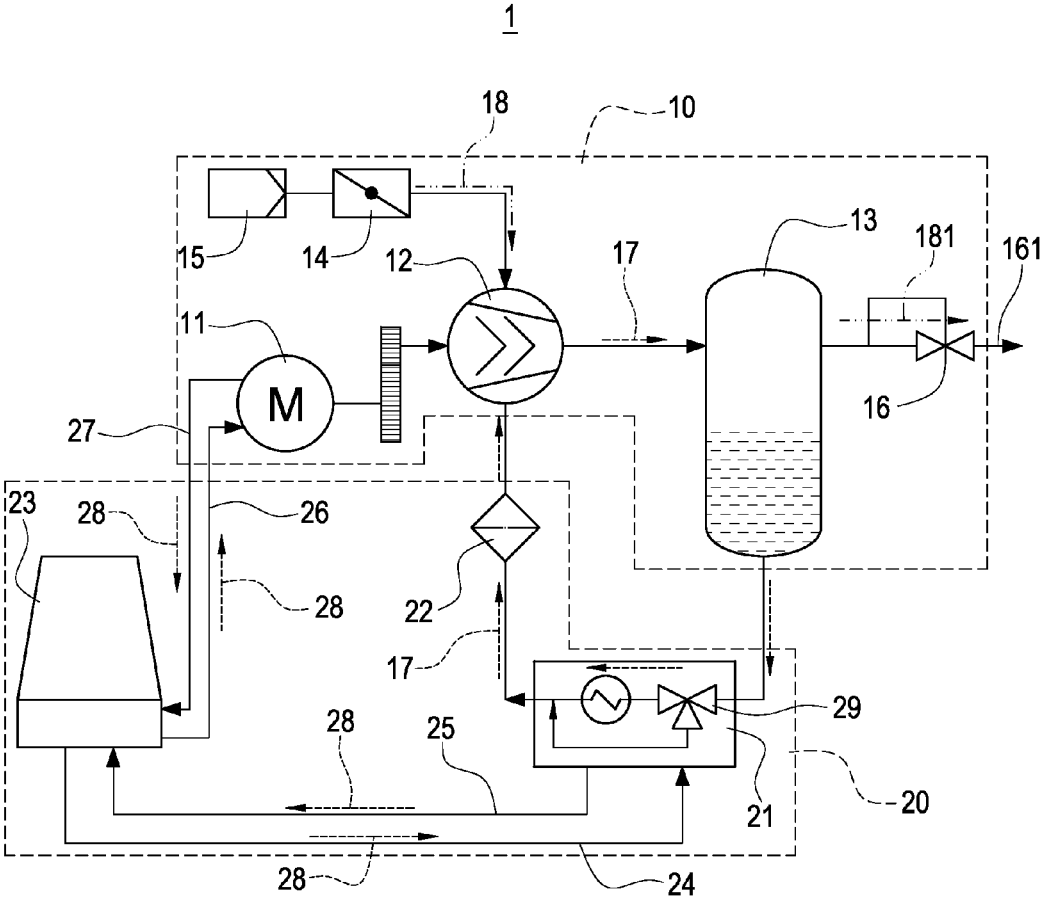
FIG. 1 is a schematic view of a first preferred embodiment of the present invention.

The technical contents of the present invention will become apparent with the detailed description of preferred embodiments accompanied with the illustration of related drawings as follows. The same numerals are used for representing same respective elements in the drawings.

With reference to FIG. 1 for a schematic view of an air compression system 1 in accordance with the first preferred embodiment of the present invention, the air compression system 1 comprises an air compression device 10 and a cooling structure 20.

The air compression device 10 includes a liquid-cooled motor 11, a compressor 12, a liquid-gas separating cylinder 13, an intake valve 14, an air filter 15, a pressure maintaining valve 16 and a lubricating liquid 17, wherein the liquid-cooled motor 11 is coupled to the compressor 12 to drive the compressor 12 to operate by a gear transmission method. The liquid-gas separating cylinder 13 interconnect the compressor 12; the intake valve 14 interconnects the compressor 12; the air filter 15 interconnects the intake valve 14; the pressure maintaining valve 16 interconnects the liquid-gas separating cylinder 13 and includes a compressed gas outlet 161; and the lubricating liquid 17 is filled into the compressor 12.

The cooling structure 20 includes a radiator 21, a filter 22, a cooler 23, a first liquid conveying tube 24, a second liquid conveying tube 25, a third liquid conveying tube 26, a fourth liquid conveying tube 27 and a cooling liquid 28, wherein the radiator 21 interconnects the liquid-gas separating cylinder 13 and the filter 22, and the filter 22 interconnects the compressor 12, such that the radiator 21 interconnects the compressor 12 through the filter 22 and the radiator 21 is capable of cooling the lubricating liquid 17 in the compressor 12; the first liquid conveying tube 24 bridges and interconnects the radiator 21 and the cooler 23; the second liquid conveying tube 25 bridges and interconnects the radiator 21 and the cooler 23; the third liquid conveying tube 26 bridges and interconnects the liquid-cooled motor 11 and the cooler 23; the fourth liquid conveying tube 27 bridges and interconnects the liquid-cooled motor 11 and the cooler 23; and the cooling liquid 28 is filled into the cooler 23, and a portion of the cooling liquid 28 is inputted into the radiator 21 through the first liquid conveying tube 24 and flows back to the cooler 23 through the second liquid conveying tube 25, and the other portion of the cooling liquid 28 is inputted into liquid-cooled motor 11 through the third liquid conveying tube 26 and flows back to the cooler 23 through the fourth liquid conveying tube 27 to cool the radiator 21 and the liquid-cooled motor 11 simultaneously, so that the radiator 21 can be used to cool the lubricating liquid 17.

During use, air 18 in the environment is filtered by the air filter 15 and then sucked into the compressor 12 through the intake valve 14, and the liquid-cooled motor 11 drives the compressor 12 to operate and compress the air 18. When the air 18 is compressed in the compressor 12, the compressor 12 will generate heat energy, so that the low-temperature lubricating liquid 17 in the compressor 12 will absorb the heat energy to become a high-temperature lubricating liquid 17, and then the compressed air in the compressor 12 is mixed with the high-temperature lubricating liquid 17 to form a high-pressure high-temperature gas-liquid mixed fluid which will enter into the liquid-gas separating cylinder 13 for a gas-liquid separation procedure, so as to obtain a high-pressure gas 181 and a high-temperature lubricating liquid 17, and the high-pressure gas 181 flows to the outside through the compressed gas outlet 161 of the pressure maintaining valve 16 to ensure that the high-pressure gas 181 outputted from the air compression system 1 is maintained at a constant pressure.

The high-temperature lubricating liquid 17 separated from the liquid-gas separating cylinder 13 flows into the radiator 21. After the radiator 21 absorbs the heat energy of the high-temperature lubricating liquid 17 to drop the temperature of the high-temperature lubricating liquid 17 and change the high-temperature lubricating liquid 17 into a low-temperature lubricating liquid 17, impurities in the low-temperature lubricating liquid 17 are filtered by the filter 22, and the low-temperature lubricating liquid 17 enters into the compressor 12 for the next cycle. Such arrangement not just achieves the effect of lubricating the compressor 12, but also achieves the effect of cooling the compressor 12.

In addition, the cooling liquid 28 in the cooler 23 is inputted into the radiator 21 through the first liquid conveying tube 24, so that the cooling liquid 28 absorbs the heat energy of the radiator 21 to drop the temperature of the radiator 21, and the radiator 21 can continue cooling the high-temperature lubricating liquid 17. After the cooling liquid 28 absorbs the heat energy of the radiator 21 and becomes a high-temperature cooling liquid 28, the high-temperature cooling liquid 28 flows back to the cooler 23 through the second liquid conveying tube 25, such that the high-temperature cooling liquid 28 is cooled by the cooler 23 to become the low-temperature cooling liquid 28 again, and the low-temperature cooling liquid 28 enters into the first liquid conveying tube 24 again. In the meantime, the cooling liquid 28 in the cooler 23 is inputted into the liquid-cooled motor 11 through the third liquid conveying tube 26 for cooling the liquid-cooled motor 11. After the low-temperature cooling liquid 28 absorbs the heat energy generated by the liquid-cooled motor 11 to become the high-temperature cooling liquid 28, the high-temperature cooling liquid 28 flows back into the cooler 23 through the fourth liquid conveying tube 27. After the cooler 23 cools the high-temperature cooling liquid 28 to change the high-temperature cooling liquid 28 into the low-temperature cooling liquid 28, the low-temperature cooling liquid 28 flows into the third liquid conveying tube 26 and gets ready for the next cooling cycle of the liquid-cooled motor 11, so as to achieve the effect of cooling the liquid-cooled motor 11 continuously.

The cooling liquid 28 is passed from the cooler 23 to the radiator 21 and the liquid-cooled motor 11 through the first liquid conveying tube 24 and the third liquid conveying tube 26 to achieve the effect of cooling the lubricating liquid 17 passing through the radiator 21 and the liquid-cooled motor 11 simultaneously. Since both liquid-cooled motor 11 and radiator 21 use the same cooler 23, therefore additional cost and space for installing the cooler of the liquid-cooled motor 11 are saved, so as to achieve the effects of saving the space occupied by the cooling structure 20, reducing the total volume of the air compression system 1, and lowering the material cost. In addition, the liquid-cooled motor 11 and the radiator 21 use the same cooler 23, so that the power consumption of the air compression system 1 can be saved.

Since the liquid-cooled motor 11 is cooled by the low-temperature cooling liquid 28 provided by the cooler 23, therefore the heat dissipating efficiency of the liquid-cooled motor 11 is improved to extend the service life of the liquid-cooled motor 11 and reduce the level of noise of the liquid-cooled motor 11.

In addition, the low-temperature lubricating liquid 17 cooled by the radiator 21 is filtered by the filter 22 to remove impurities and prevent the impurities from entering into the compressor 12 or affecting the operation of the compressor 12, so as to ensure the normal operation of the compressor 12, and extend the service life of the compressor 12.

In addition, a thermal control valve 29 or any other temperature control system may be installed between the radiator 21 and the liquid-gas separating cylinder 13 for controlling the flow of the lubricating liquid entering into the radiator 21, so that the low-temperature lubricating liquid 17 cooled by the radiator 21 can be maintained at a constant temperature, and the compressor 12 has a better lubricating effect.

Figure 2:
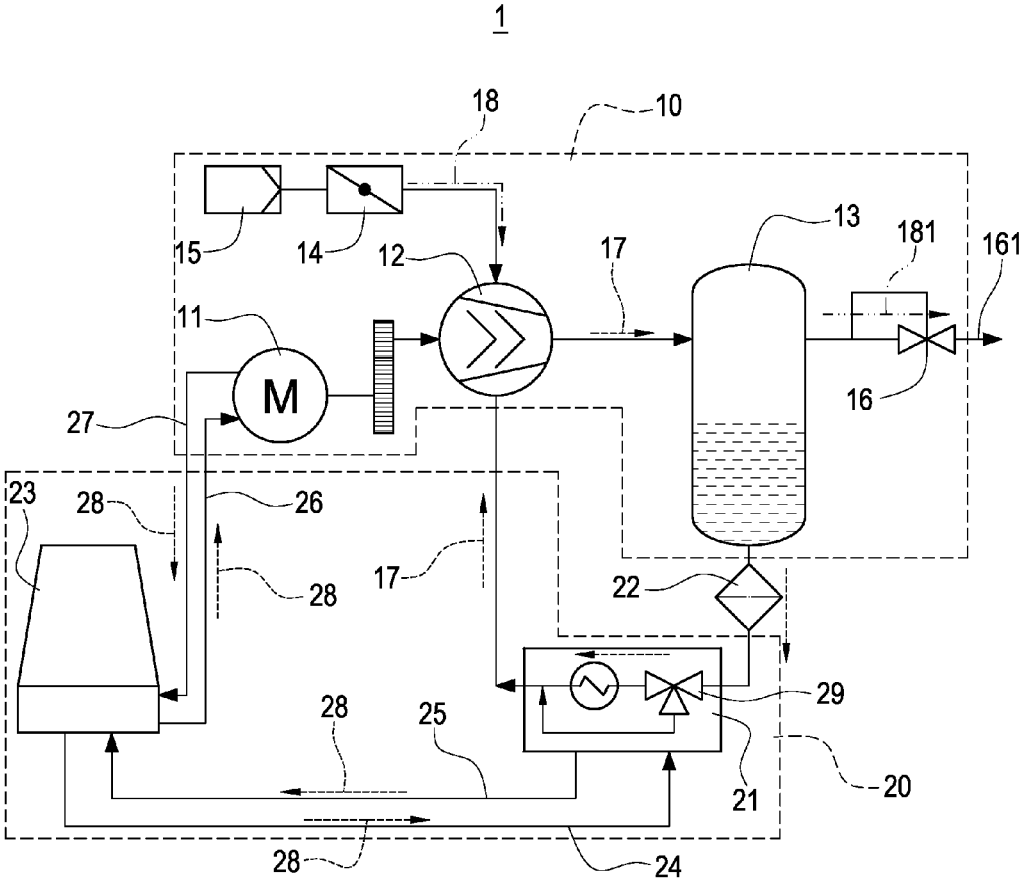
FIG. 2 is a schematic view of a second preferred embodiment of the present invention.

With reference to FIG. 2 for a schematic view of the second preferred embodiment of the present invention, the difference of this preferred embodiment from the first preferred embodiment resides on that the filter 22 is installed between the liquid-gas separating cylinder 13 and the radiator 21, so that the liquid-gas separating cylinder 13 interconnects the radiator 21 through the filter 22, and the high-temperature lubricating liquid 17 separated by the liquid-gas separating cylinder 13 has to pass through the filter 22 for a filtering process before entering into the radiator 21, and such arrangement also achieves the effects of filtering the impurities, ensuring a smooth operation of the compressor 12, and extending the life of the compressor 12.

Figure 3:
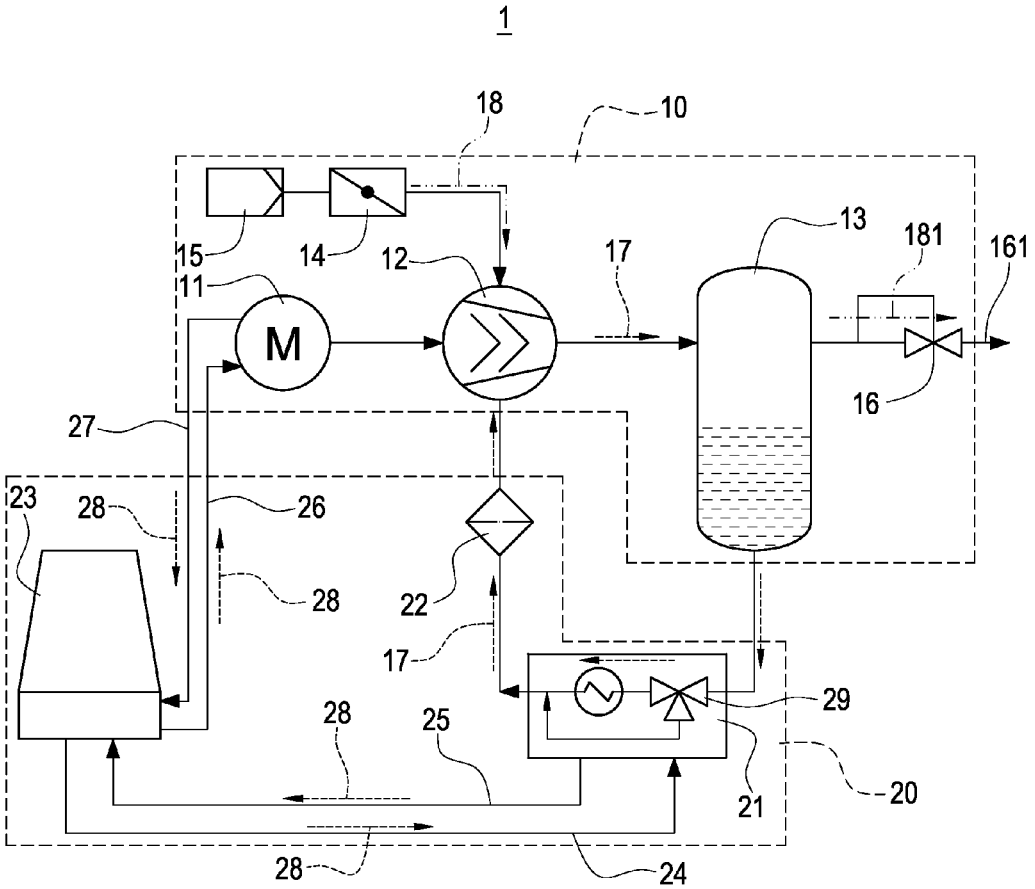
FIG. 3 is a schematic view of a third preferred embodiment of the present invention.

With reference to FIG. 3 for the third preferred embodiment of the present invention, the difference of this preferred embodiment from the previous preferred embodiments resides on that the compressor 12 is driven by the rotating shaft of the liquid-cooled motor 11 directly for the operation of the compressor 12.

Figure 4:
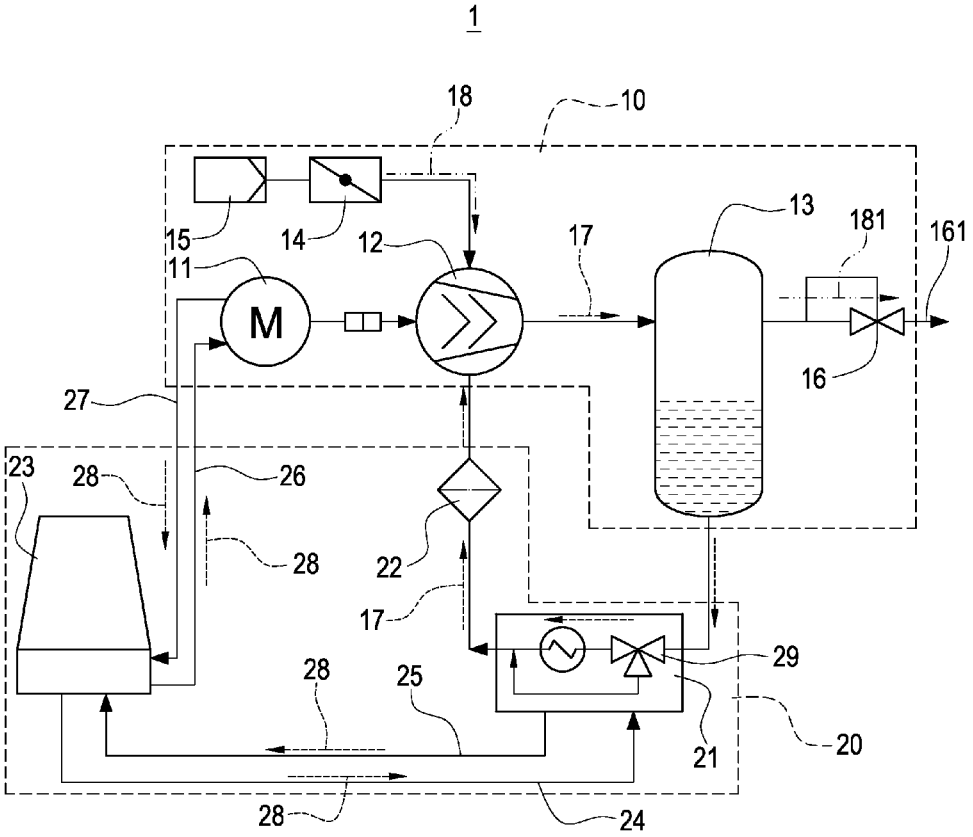
FIG. 4 is a schematic view of a fourth preferred embodiment of the present invention.

With reference to FIG. 4 for the fourth preferred embodiment of the present invention, the difference of this preferred embodiment from the previous preferred embodiments resides on that the rotating shaft of the liquid-cooled motor 11 is coupled to the rotating shaft of the compressor 12 through a shaft coupler, so that the liquid-cooled motor is driven by the rotating shaft of the liquid-cooled motor to rotate the shaft coupler, and then the shaft coupler drives the rotating shaft of the compressor to rotate, so as to drive the operation of the compressor 12.

Figure 5:
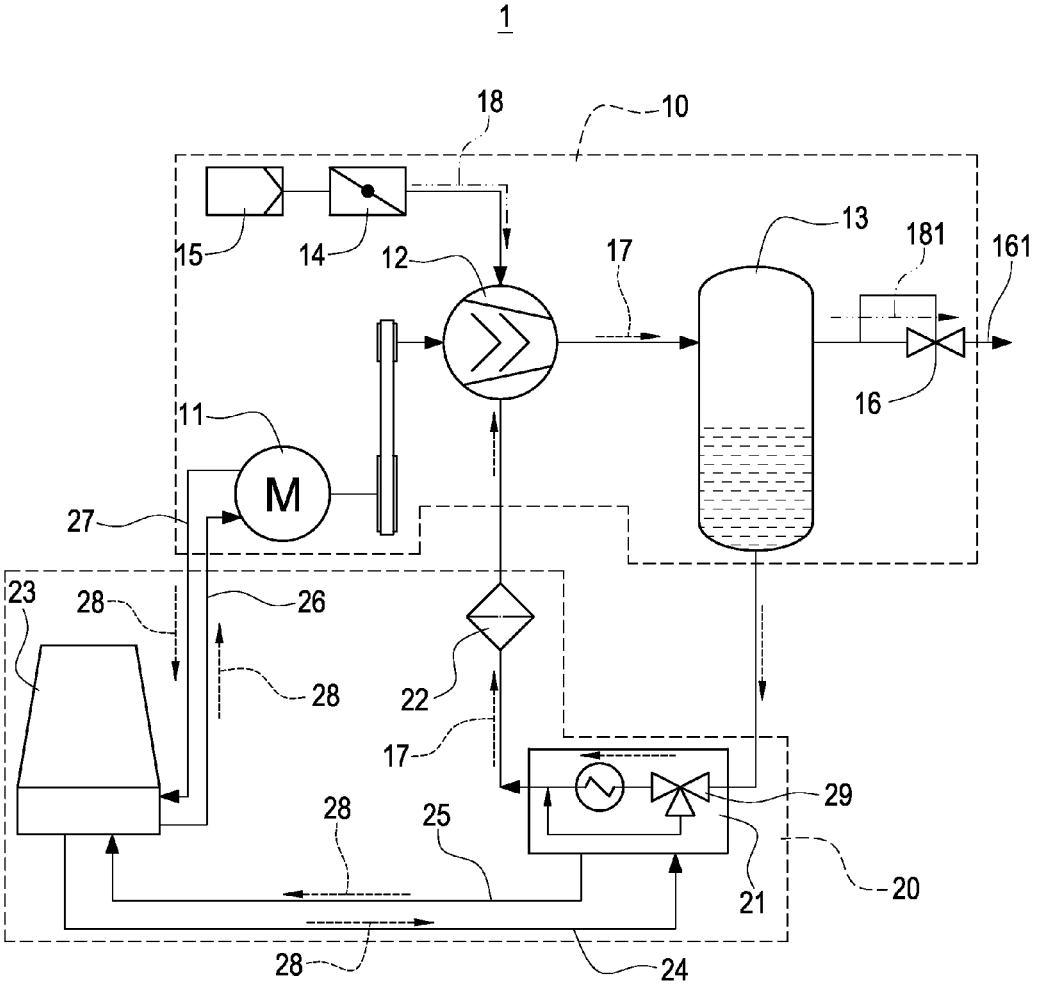
FIG. 5 is a schematic view of a fifth preferred embodiment of the present invention.

With reference to FIG. 5 for the fifth preferred embodiment of the present invention, the difference of this preferred embodiment from the previous preferred embodiments resides on that the liquid-cooled motor 11 is driven by the transmission of a belt pulley to drive the operation of the compressor 12.

While the invention has been described by means of specific embodiments, numerous modifications and variations could be made thereto by those skilled in the art without departing from the scope and spirit of the invention set forth in the claims.

What is claimed is:

1. An air compression system, comprising:

an air compression device, comprising a liquid-cooled motor, and a compressor and the liquid-cooled motor drives the compressor, and a cooling structure, comprising:

a cooler;

a radiator, interconnecting the compressor and the cooler, for cooling a lubricating liquid filling the compressor;

a first liquid conveying tube, two distal ends of the first liquid conveying tube directly connecting the radiator and the cooler respectively;

a second liquid conveying tube, two distal ends of the second liquid conveying tube directly connecting the radiator and the cooler respectively;

a third liquid conveying tube, two distal ends of the third liquid conveying tube directly connecting the liquid-cooled motor and the cooler respectively;

a fourth liquid conveying tube, two distal ends of the fourth liquid conveying tube directly connecting the liquid-cooled motor and the cooler respectively; and a cooling liquid circulating between the cooler and the radiator via the first liquid conveying tube and the second liquid conveying tube, and also circulating between the cooler and the liquid-cooled motor via the third conveying tube and the fourth liquid conveying tube.

2. The air compression system of claim 1, wherein the air compression device further comprises a liquid-gas separating cylinder interconnecting the radiator and the compressor.

3. The air compression system of claim 2, wherein the cooling structure further comprises a filter, and the liquid-gas separating cylinder connects to the radiator through the filter.

4. The air compression system of claim 1, wherein the cooling structure further comprises a filter, and the radiator connects to the compressor through the filter.

5. The air compression system of claim 1, wherein the air compression device further comprises an intake valve connecting to the compressor.

6. The air compression system of claim 5, wherein the air compression device further comprises an air filter connecting to the intake valve.

7. The air compression system of claim 1, wherein the air compression device further comprises a pressure maintaining valve connecting to the liquid-gas separating cylinder, and the pressure maintaining valve has a compressed gas outlet.

8. A cooling structure for an air compression system, the air compression system comprising an air compression device having a liquid-cooled motor and a compressor, the cooling structure comprising:

a cooler;

a radiator, interconnecting the compressor and the cooler, for cooling a lubricating liquid filling the compressor;

a first liquid conveying tube, two distal ends of the first liquid conveying tube directly connecting the radiator and the cooler respectively;

a second liquid conveying tube, two distal ends of the second liquid conveying tube directly connecting the radiator and the cooler respectively;

a third liquid conveying tube, two distal ends of the third liquid conveying tube directly connecting the liquid-cooled motor and the cooler respectively;

a fourth liquid conveying tube, two distal ends of the fourth liquid conveying tube directly connecting the liquid-cooled motor and the cooler respectively; and a cooling liquid circulating between the cooler and the radiator via the first liquid conveying tube and the second liquid conveying tube, and also circulating between the cooler and the liquid-cooled motor via the third conveying tube and the fourth liquid conveying tube.

9. The cooling structure for an air compression system according to claim 8, wherein the air compression device further comprises a liquid-gas separating cylinder, and the cooling structure further comprises a filter, and the liquid-gas separating cylinder connects to the radiator through the filter.

10. The cooling structure for an air compression system according to claim 8, wherein the cooling structure further comprises a filter, and the radiator connects to the compressor through the filter.

* * * * *